US006888318B2

(12) United States Patent
Childs

(10) Patent No.: US 6,888,318 B2
(45) Date of Patent: May 3, 2005

(54) ELECTROLUMINESCENT DISPLAY DEVICE

(75) Inventor: Mark J. Childs, Sutton (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 126 days.

(21) Appl. No.: 10/317,387

(22) Filed: Dec. 12, 2002

(65) Prior Publication Data

US 2003/0111964 A1 Jun. 19, 2003

(30) Foreign Application Priority Data

Dec. 18, 2001 (GB) ..... 0130176

(51) Int. Cl.[7] ..... G09G 3/10
(52) U.S. Cl. ..... 315/169.3; 345/76
(58) Field of Search ..... 315/169.1, 169.3; 345/41, 45, 48, 55, 60, 76, 80, 92, 211

(56) References Cited

U.S. PATENT DOCUMENTS 4,528,480 A * 7/1985 Unagami et al. ..... 315/169.1
5,952,789 A * 9/1999 Stewart et al. ..... 315/169.4
6,188,375 B1 2/2001 Kagey ..... 345/76
6,448,718 B1 * 9/2002 Battersby ..... 315/169.3
2002/0021293 A1 * 2/2002 Tam ..... 345/204
2002/0033718 A1 * 3/2002 Tam ..... 327/94

FOREIGN PATENT DOCUMENTS

EP 0717446 6/1996 ..... H01L/27/15
WO WO9636959 11/1996 ..... G09G/3/30
WO WO0173738 4/2001 ..... G09G/3/30

* cited by examiner

*Primary Examiner*—Thuy Vinh Tran

(57) ABSTRACT

An electroluminescent (EL) display device comprises an array of display pixels, each display pixel comprising an EL display element and a driving circuit. A digital pixel drive signal determines whether the pixel is on or off, and a selected one of a plurality of supply voltages is switched to the EL display element. This device enables a digital drive scheme to be implemented, but the provision of a plurality of different supply voltages enables a grey scale to be implemented without requiring time or area ratio systems to be employed. Alternatively, the device of the invention can allow time or area ratio techniques to be improved.

20 Claims, 3 Drawing Sheets

ELECTROLUMINESCENT DISPLAY DEVICE

The invention relates to electroluminescent display devices, for example using organic LED devices such as polymer LEDs.

Matrix display devices employing electroluminescent, light-emitting, display elements are well known. The display elements may comprise organic thin film electroluminescent elements, for example using polymer materials, or else light emitting diodes (LEDs) using traditional III–V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer.

The polymer material can be fabricated using a CVD process, or simply by a spin coating technique using a solution of a soluble conjugated polymer. Organic electroluminescent materials exhibit diode-like I–V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-addressed display elements, so that a conventional, analogue drive scheme involves supplying a controllable current to the display element. It is known to provide a current source transistor as part of the pixel configuration, with the gate voltage supplied to the current source transistor determining the current through the display element. A storage capacitor holds the gate voltage after the addressing phase. However, different transistor characteristics across the substrate give rise to different relationships between the gate voltage and the source-drain current, and artefacts in the displayed image result.

Digital drive schemes have also been proposed. In such schemes, the LED device is effectively driven to two possible voltage levels. This reduces the power consumption in the pixel circuit, because a transistor is no longer required to operate in the linear region as a current source. Instead, all transistors can be fully on or fully off, which reduces power consumption. Such a drive scheme is less sensitive to transistor characteristic variations for the same reason. This approach only gives two possible pixel outputs. However, grey scale pixel outputs can be achieved by a number of methods.

In one approach, pixels can be grouped to form larger pixels. Pixels within the group can be addressed independently, so that a grey scale is produced which is a function of the number of pixels within the group activated. In the following description, this will be referred to as the area ratio method. A drawback of this approach is the reduced resolution of the display and the increased pixel complexity.

In an alternative approach, pixels can be turned on and off more quickly than the frame rate, so that a grey scale is implemented as function of the duty cycle with which the pixel is turned on. In the following description, this will be referred to as the time ratio method. For example, a frame period may be divided into sub-frame periods in the ratio 1:2:4 (giving 8 evenly spaced grey scale values). This increases the required driving capability (or else requires a reduction in the frame rate), and therefore increases the cost of the display.

According to a first aspect of the invention, there is provided an electroluminescent (EL) display device comprising an array of display pixels, each display pixel comprising an EL display element and a driving circuit, wherein the driving circuit comprises a switching device for selectively switching a supply voltage to the EL display element or else substantially isolating the display element from the supply, voltage, in response to a pixel drive signal, wherein the driving circuit enables a selected one of a plurality of supply voltages to be switched to the EL display element.

This device enables a digital drive scheme to be implemented, in which the EL display element is either supplied with a constant supply voltage or is turned off. This enables a low power drive circuit to be implemented, which also does not suffer from variations in switching device characteristics over the display substrate. The provision of a plurality of different supply voltages enables a grey scale to be implemented without requiring time or area ratio systems to be employed. Alternatively, the device of the invention can allow time or area ratio techniques to be improved.

Each pixel may comprise a multiplexer for providing the selected supply voltage from a plurality of supply voltage lines to the pixel driving circuit.

Preferably, the switching device comprises a thin film transistor coupled between supply voltage lines and the EL display element, the transistor being driven substantially fully on or off by the pixel drive signal. This is one pixel design for providing the digital drive scheme.

There may be three supply voltage lines, for example with the voltages on the three supply voltage being in the ratio 1:2:4. Whilst this only provides three different grey levels, these three supply voltage levels can be used in conjunction with time or area ratio techniques to increase the number of grey scales without further penalties (in resolution or in speed).

Each pixel may comprise first and second pixel drive signal conductors, with one conductor operating the switching device (i.e. providing the digital pixel drive signal), and the other selecting the desired supply voltage.

In another embodiment, one of the plurality of supply voltages may be such that the EL display element is off. This may be desired when combining the multiple supply voltage feature with an area ratio technique. In particular, a plurality of groups of pixels may be defined, with all pixels in a group sharing a common pixel drive signal conductor. Thus, a group of pixels is effectively a single sub-pixellated pixel, which is driven by a single pixel drive signal. However, a supply voltage can be selected independently for each pixel within the group. In this way, the number of grey scales which can be provided by the sub-pixellation is increased.

The display device of the invention may be used in a portable device, such as a mobile phone.

The invention also provides a method of driving an electroluminescent (EL) display device comprising an array of pixels, each pixel comprising an electroluminescent display element and a drive circuit, the method comprising, for each pixel of the display, supplying a first drive signal to the pixel for selectively switching the pixel on or off so that a supply voltage is switched to the EL display element or, else is substantially isolated from the EL display element, and wherein the method further comprises selecting the supply voltage level from a plurality of supply voltage levels.

In this method, a digital drive scheme is implemented, because a first drive signal either turns the pixel on or off, and does not need to encode brightness level information. However, the power supply level within the pixel is used to create a grey scale.

A second drive signal is preferably supplied to the pixel for selecting the one of the plurality of supply voltage levels. In this way, the power can be selected for each pixel. Alternatively, all pixels may be driven to different powers in turn, so that a time ratio method is implemented.

The first drive signal is preferably supplied to an address transistor of the pixel and causes a drive transistor of the pixel to be turned on or off, thereby operating the pixel in a digital mode. The second drive signal is preferably supplied to a power line selection circuit.

This method may be combined with a conventional area ratio method. Thus, a shared first drive signal can be supplied to a group of pixels, and wherein individual second drive signals are supplied to the pixels in the group. The group of pixels is effectively a single master pixel, and the individual pixels of the group are then effectively sub-pixels. So that all sub-pixels of the group can be addressed by a signal drive signal (even though some sub-pixels may need to be turned on and others turned off at any point in time), one of the plurality of supply voltages levels is preferably for turning the pixel off. In this way, a sub-pixel can be turned off even though the master pixel group is addressed. This reduces the number of conductors required to drive the sub-pixels.

The method may additionally (or alternatively) be combined with a time ratio method. Thus, all pixels of the display may be addressed in a frame, and wherein each frame comprises a number of sub-frames. Different supply voltage levels can then be selected for different sub-frames. This enables the conventional binary scale of sub-frame times (for example 1:2:4) to be altered, in particular to avoid the need for a very short first sub-frame. For example, the sub-frames may be of equal duration.

When the method of the invention is combined with the time ratio method, this can be achieved without any change to a conventional pixel design, and all hardware changes can be in the driving circuitry, to ensure that a different supply voltage is generated for the different pixel sub-frames.

Embodiments of display devices in accordance with the invention will now be described, by way of example, with reference to the accompanying drawings, in which.

Figure 1:
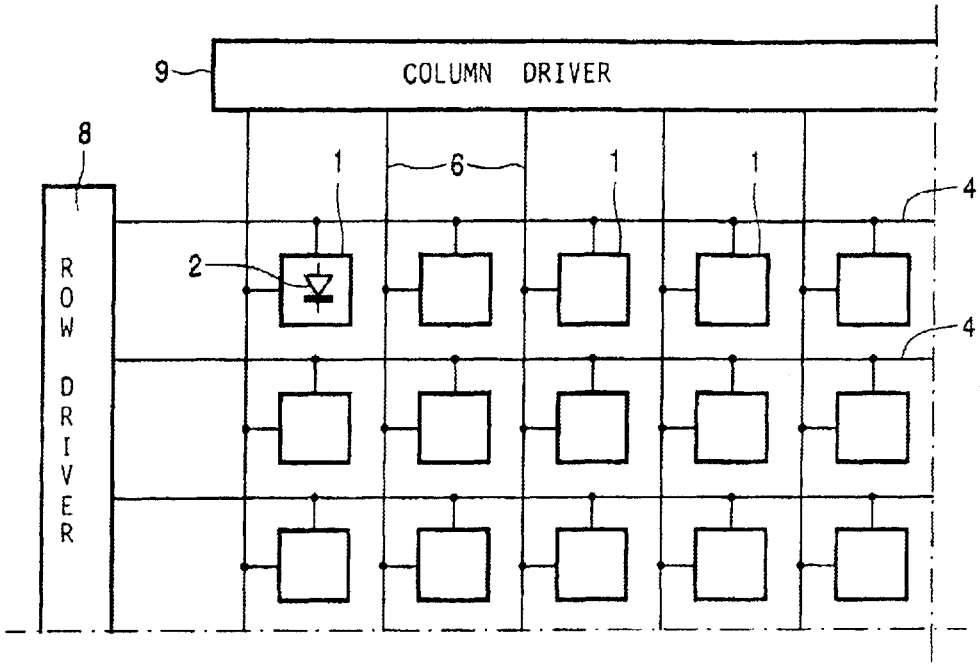
FIG. 1 shows an EL display device according to the invention.

Referring to FIG. 1, an active matrix addressed electroluminescent display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the Figure for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support. Typically, the thickness of the organic electroluminescent material layer is between 100 nm and 200 nm. Typical examples of suitable organic electroluminescent materials which can be used for the elements 2 are known and described in EP-A-0 717446. Conjugated polymer materials as described in WO96/36959 can also be used.

Figure 2:
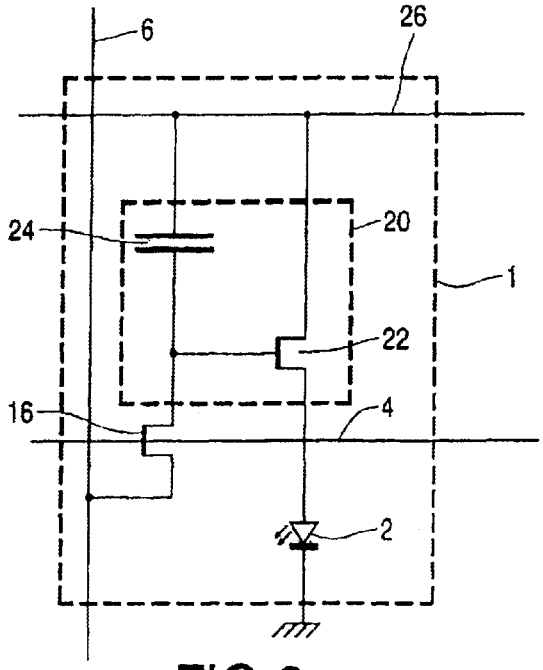
FIG.2 PRIOR ART
FIG. 2 is a simplified schematic diagram of a known pixel circuit for current-addressing an EL display pixel.

FIG. 2 shows in simplified schematic form a known pixel and drive circuitry arrangement. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended.

In order to drive the pixel digitally, the possible gate voltages on the drive transistor 22 in combination with the voltage on the power rail 26 supplying the current source 20 are selected such that the transistor is fully turned on or off. When fully turned on, there is almost no voltage drop across the drive transistor 22, and the voltage on the supply rail 26 is effectively provided on the display element 2. The voltage on the column conductor 6 is used to select one of two possible drive voltages for the display element 2. In order to address the drive transistor fully on or fully off, gate voltages of either 0V or 10V may for example be applied across the capacitor.

In accordance with the invention, a number of different voltages can be provided on the power rail 26. The power rail voltage can then be used to vary the brightness of the LED. This enables the low power consumption of a fully turned on or off drive transistor to be maintained as well as the independence of the brightness on the driving TFT characteristics.

Figure 3:
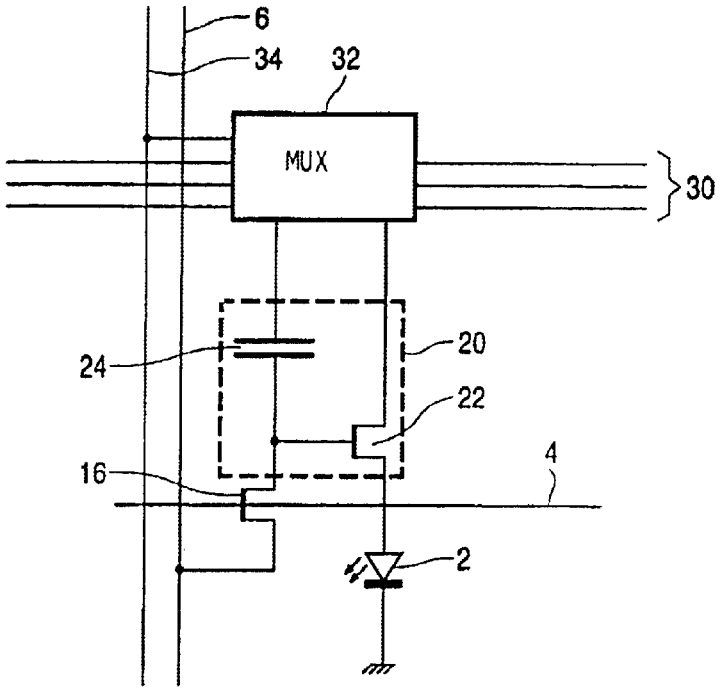
FIG. 3 shows a first example of pixel circuit according to the invention.

FIG. 3 shows one possible implementation of the pixel circuit to obtain the operation described above. The pixel circuit of the invention is shown as an improvement to the known pixel design of FIG. 2, and the same reference numbers are used to denote the same components.

The pixel circuit of the invention has a group 30 of voltage supply lines, for example three as shown in FIG. 3. The voltage from a selected one of the lines 30 is switched by the drive transistor 22 to the EL display element 2. A digital drive scheme is implemented, in that the drive transistor is driven fully on or off, but a number of different output levels, corresponding to the number of voltage lines 30, can be selected. Thus, a grey scale can be implemented without requiring time or area ratio systems to be employed.

Alternatively, the device of the invention can allow time or area ratio techniques to be improved, as will be discussed below. The voltages on the supply lines 30 can easily be generated very accurately with hardware external to the main display device substrate.

In order to select one of the supply voltage lines 30, each pixel has a multiplexer 32 (or other power line selection circuit) which is controlled using a control line 34.

The multiplexer 32 can be implemented in a number of ways. The simplest method is to use a simple array of transistor switches in parallel between the power lines and the drive transistor, with one switch associated with each of the power lines 30. This requires a control line for each transistor (so that one is turned on and the others are turned off), which is realistic for a small number of power lines.

The number of select lines can be reduced by using different types of transistor for different power lines. For example, the power lines can be in pairs, with a n-type transistor coupling one of the lines to the drive transistor and a p-type transistor coupling the other of the lines to the drive transistor. For example, a single select line can then control power lines 30 in which there are two power lines.

In one example, the voltages on three supply voltage lines are in the ratio 1:2:4. This provides three different grey levels, without requiring area or time ratio techniques. However, the multiple voltage level pixel of the invention is preferably combined with time or area ratio techniques, to provide an increase in the number of grey scales without further penalties (in resolution or in speed).

Figure 4:
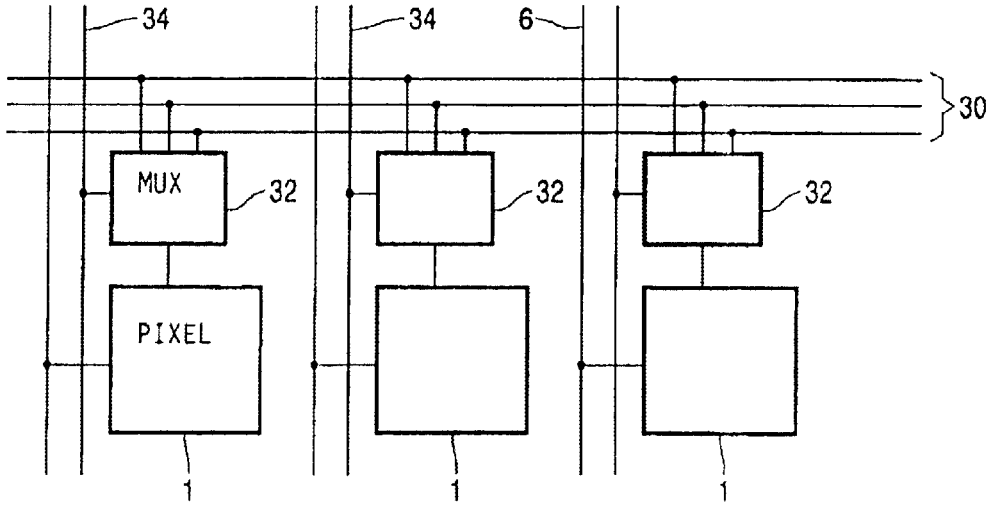
FIG. 4 shows how the pixel circuit of the invention can be used in combination with an area ratio grey scale drive scheme.

FIG. 4 shows three pixels 1, each provided with a multiplexer circuit 32 controlled by a respective second drive signal line 34. The three pixels comprise sub-pixels of a larger pixel, so that the combined output can define grey levels (in conventional manner). However, the combination of the multiple voltage levels with the three sub-pixel design increases the number of grey levels from 3 to 11 (if the ratio of the voltages on the supply lines is 1:2:4, as combined voltages of 1–10 and 12 can be obtained). If a different ratio on the voltage supply lines is used, even more grey levels can be achieved.

In the example of FIG. 4, each sub-pixel is provided with the two pixel drive lines 6,34, so that each sub-pixel effectively has four levels (off and the three voltage levels).

Figure 5:
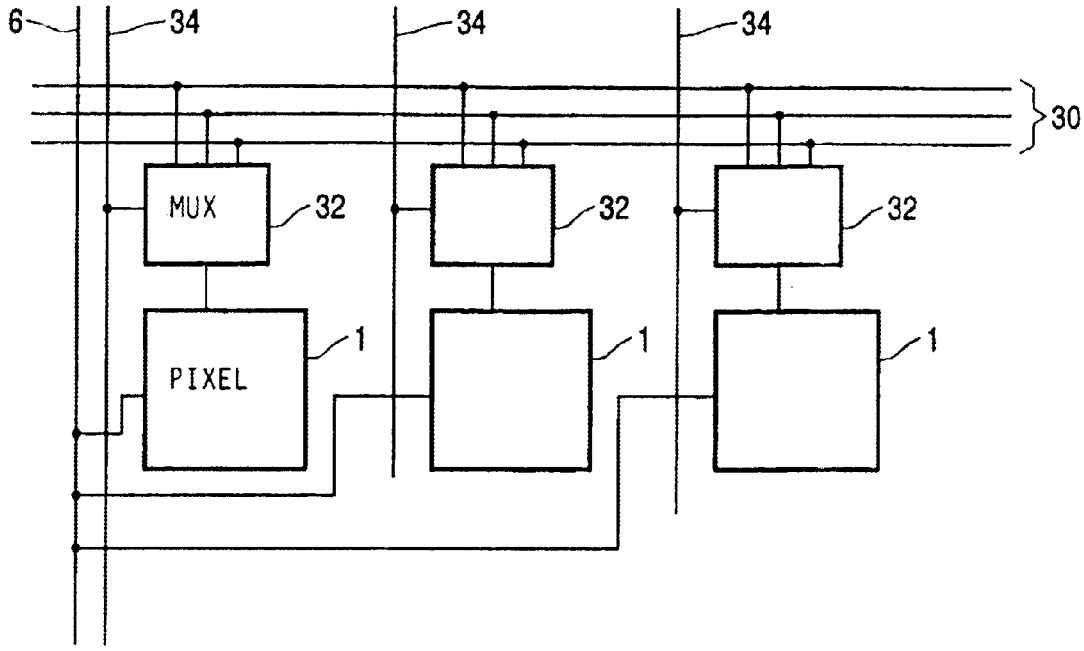
FIG. 5 shows a simplification to FIG. 4.

In the example of FIG. 5, one of the plurality of supply voltages may be such that the EL display element is off, for example zero Volts. FIG. 5 again shows three sub-pixels of a larger pixel. In this example, all pixels in the group share a common pixel drive signal conductor 6, so that all sub-pixels are turned on or off together. However, a supply voltage can be selected independently for each pixel within the group, so that each pixel has a second drive signal conductor 34. This reduces the number of column conductors, although it does reduce the number of levels of each sub-pixel to three (off and the two other voltage levels).

The invention may also be combined with a time ratio method. Thus, all pixels of the display may be addressed in a number of sub-frames which together make up a frame. The time ratio method conventionally uses sub-frame periods in the ratio 1:2:4 to gain the maximum number of evenly spaced grey levels. The invention can be used to avoid the very short first sub-frame period and the very long last sub-frame period. In particular, different supply voltage levels can be selected for different sub-frames. For example, the sub-frames may be of equal duration, and then by stepping the power supply voltages in the same ratio of 1:2:4, the same grey scale resolution can be achieved, but avoiding the short first sub-frame. By increasing the length of the first sub-frame, it is less susceptible to timing errors which cause errors with low brightness values, which are most obvious to the viewer.

The time ratio and area ratio schemes may both be combined, to produce many more grey scales. In a preferred design, three (or more) sub-pixels would operate with three (or more) sub-frames of equal length, with the power rail stepped to give light output power per sub-frame in the ratio 1:2:4.

In one version, the power for all three sub-pixels of all pixels can be switched together. This does not have the flexibility of individually switching sub-pixels. However, it has the advantage that the system can be implemented entirely in the driving hardware and so does not require a specific pixel circuit. Instead, a conventional pixel circuit can be used, and the voltage supply line for the entire display is driven to the desired voltage for the particular sub-frame at that time. Thus, the selected supply voltage is supplied to the pixels of the display by a driver circuit external to the array of pixels.

Figure 6:
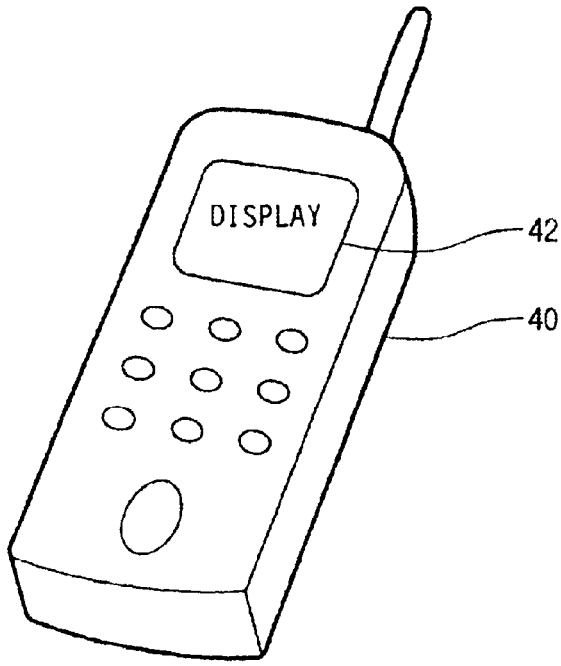
FIG. 6 shows a mobile telephone using the display of the invention.

The display device of the invention may be used in a portable device, such as a mobile phone. FIG. 6 shows a mobile telephone 40 incorporating a display 42 of the invention.

The pixel circuits described above are only examples of possible pixel structures which can be improved by the invention. In particular, any pixel design for providing a fixed voltage to the EL display element can be improved using the teaching of the invention, either by incorporating a selection circuit into the pixel or else by modifying the external circuitry for providing the supply voltage to the pixels. Other possible pixel configurations will be known to those skilled in the art, and the invention can provide benefits in many different such configurations.

Specific examples have been given above with three voltage levels. However, one preferred embodiment is to use only two voltage levels. Although the examples above incorporate selective switching of power lines at a pixel level, it may be preferred in many case to maintain a simple pixel layout, and to provide power supply lines which are switched by circuits off the display, for example as described above in connection with a time ratio scheme. For example, the frame period could be divided into two equal sub-frames and the power line set at different values for each.

From reading the present disclosure, other modifications will be apparent to persons skilled in the art. Such modifications may involve other features which are already known in the field of matrix electroluminescent displays and component parts thereof and which may be used instead of or in addition to features already described herein.

What is claimed is:

1. An electroluminescent (EL) display device comprising an array of display pixels, each display pixel comprising an EL display element and a driving circuit, wherein the driving circuit comprises a switching device for selectively switching a supply voltage to the EL display element or else substantially isolating the display element from the supply voltage, in response to a pixel drive signal, wherein the driving circuit enables a selected one of a plurality of supply voltages to be switched to the EL display element.

2. A display device as claimed in claim 1, wherein each pixel comprises a multiplexer for providing the selected supply voltage from a plurality of supply voltage lines to the pixel driving circuit.

3. A display device as claimed in claim 1, wherein the switching device comprises a thin film transistor coupled between supply voltage lines and the EL display element, the transistor being driven substantially fully on or off by the pixel drive signal.

4. A display device as claimed in claim 1, wherein there are three supply voltage lines.

5. A display device as claimed in claim 4, wherein the voltages on the three supply voltage lines are substantially in a ratio 1:2:4.

6. A display device as claimed in claim 1, wherein each pixel comprises first and second pixel drive signal conductors, wherein the first pixel drive signal conductor is for operating the switching device, and the second pixel drive signal conductor is for selecting the one of the plurality of supply voltages.

7. A display device as claimed in claim 1, wherein one of the plurality of supply voltages is such that, upon selection, the EL display element is off.

8. A display device as claimed in claim 7, wherein a plurality of groups of pixels are defined, wherein all pixels in each group share a common pixel drive signal conductor, but wherein a supply voltage can be selected independently for each pixel within the group.

9. A display device as claimed in claim 1, wherein the selected one of the plurality of supply voltages is supplied to the pixels of the display by a driver circuit external to the array of pixels.

10. A portable electronic device comprising a display device comprising an array of display pixels, each display pixel comprising an EL display element and a driving circuit, wherein the driving circuit comprises a switching device for selectively switching a supply voltage to the EL display element or else substantially isolating the display element from the supply voltage, in response to a pixel drive signal, wherein the driving circuit enables a selected one of a plurality of supply voltages to be switched to the EL display element.

11. A method of driving an electroluminescent (EL) display device comprising an array of pixels, each pixel comprising an electroluminescent (EL) display element and a drive circuit, the method comprising, for each pixel of the display, supplying a first drive signal to the pixel for selectively switching the pixel on or off so that a supply voltage is switched to the EL display element or else is substantially isolated from the EL display element, and wherein the method further comprises selecting the supply voltage level from a plurality of supply voltages levels.

12. A method as claimed in claim 11, wherein a second drive signal is supplied to the pixel for selecting the one of the plurality of supply voltage levels.

13. A method as claimed in claim 12, wherein the second drive signal is supplied to a power line selection circuit of the pixel.

14. A method as claimed in claim 11, wherein the first drive signal is supplied to an address transistor of the pixel and causes a drive transistor of the pixel to be turned on or off.

15. A method as claimed in claim 12, wherein a shared first drive signal is supplied to a group of pixels, and wherein individual second drive signals are supplied to the pixels in the group.

16. A method as claimed in claim 15, wherein one of the plurality of supply voltages levels is for turning the pixel off.

17. A method as claimed in claim 11, wherein all pixels of the display are addressed in a frame, and wherein each frame comprises a number of sub-frames.

18. A method as claimed in claim 17, wherein different supply voltage levels are selected for different sub-frames.

19. A method as claimed in claim 18, wherein the sub-frames are of equal duration.

20. A method as claimed in claim 17, wherein the number of sub-frames is three.

* * * * *